United States Patent [19]

Pettinelli

[11] Patent Number: 4,856,471

[45] Date of Patent: Aug. 15, 1989

[54] AUTOMATIC ENGINE IGNITION SHUT-OFF DEVICE

[76] Inventor: Anthony J. Pettinelli, 413 Lawrence St., Rome, N.Y. 13440

[21] Appl. No.: 126,552

[22] Filed: Nov. 30, 1987

[51] Int. Cl.[4] ..... F02B 77/08

[52] U.S. Cl. ..... 123/198 DC; 123/198 D

[58] Field of Search ..... 123/198 D, 198 DC, 397

[56] References Cited

U.S. PATENT DOCUMENTS

| | | | |
|---|---|---|---|
| 3,273,552 | 9/1966 | Plath | 123/198 DC |
| 3,487,183 | 12/1969 | Schulman | 123/198 DC |
| 3,695,379 | 10/1972 | Veilleux | 180/103 |
| 3,798,402 | 3/1974 | Raab | 123/198 DC |

OTHER PUBLICATIONS

"The Solution to Stuck Throttles", Stock Car Racing, Sep. (1987), pp. 58, 59.

*Primary Examiner*—Willis R. Wolfe

*Assistant Examiner*—M. Macy

*Attorney, Agent, or Firm*—Wall and Roehrig

[57] ABSTRACT

Apparatus for immediately shutting down the engine of a motor vehicle in the event that the throttle sticks in an open position. A connecting member is secured at one end of the throttle linkage of a carburetor and at the other end to a piston slidably contained within a housing. A cut-off spring acts between the housing and the piston with sufficient force to drive the piston against the push button actuator of a cut-off switch wired into the engine ignition system. The opposite end of the connecting member is attached to the throttle return spring which acts through the connecting member with a greater opposing force than the cut-off spring to prevent the piston from cycling the shut-off switch. In the event the throttle return spring breaks or the throttle linkage becomes jammed in an open position, the cut-off spring is released and the engine immediately shut down.

14 Claims, 1 Drawing Sheet

AUTOMATIC ENGINE IGNITION SHUT-OFF DEVICE

BACKGROUND OF THE INVENTION

This invention relates to a safety device for use in a motor vehicle and, in particular, to a device for immediately shutting down the engine of a motor vehicle in the event the throttle linkage breaks or becomes jammed in a position other than idle.

As noted in detail in U.S. Pat. Nos. 3,695,379 to Veilleux and 3,487,183 to Schulman, electrical devices have heretofore been installed in the throttle mechanism of motor vehicles to shut down the engine ignition in the event the throttle return spring breaks or becomes disconnected when the engine is running. For the most part, these devices use a spring loaded shut-off switch which is wired into the ignition system of the engine and is arranged to pull against the return spring through an appropriate linkage to hold the switch closed. If the return spring fails for some reason, the switch spring is released and the switch is cycled to an opened condition thereby shutting down the engine.

These devices work very well for their intended purposes, however, they are incapable of shutting down the engine in the event that the throttle linkage becomes jammed in an open position. The jammed linkage will prevent the spring from being released and the switch will remain open despite the fact that the linkage has failed in an open position. This type of open throttle failure is one of the most dangerous situations faced by race car drivers. Under racing conditions, the throttle usually becomes jammed when the car is travelling at a high rate of speed. The driver invariably is too occupied in maintaining control of the vehicle to manually switch off the ignition.

SUMMARY OF THE INVENTION

It is therefore an object of the present invention to improve the safety of motor vehicles in general, and racing cars in particular.

It is a further object of the present invention to automatically shut off the ignition system of a motor vehicle in the event the throttle of the vehicle becomes jammed in an open position.

A still further object of the present invention is to provide a safety switch in the ignition system of a motor vehicle that will automatically open if the throttle linkage of the vehicle becomes jammed or if the throttle return spring breaks or becomes disconnected.

These and other objects of the present invention are attained by means of a button actuated cut-off switch that is mounted in a housing behind a piston so that the switch actuator can be depressed by the piston to open the normally closed switch. The switch is wired into the ignition system of the engine so that the engine is shut down immediately when the cutoff switch is opened. The body of the housing is coupled to the accelerator of the motor vehicle for movement therewith. While the piston is coupled by a connector to the return spring of the carburetor throttle linkage which pulls the piston away from the switch button actuator, a second cut-off spring is mounted within the housing which acts between the housing and the piston to drive the piston against the switch actuator with sufficient force to cycle the switch. The strength of the cut-off spring is less than that of the throttle linkage return spring so that under normal operating conditions, the piston will be retracted from the button actuator of the cut-off switch regardless of the accelerator position. However, if the throttle linkage becomes jammed for any reason, or the throttle return spring fails, the piston will be released by the return spring and driven against the cut-off switch actuator to automatically shut down the engine.

BRIEF DESCRIPTION OF THE DRAWINGS

For a better understanding of these and other objects of the present invention, reference is made to the following detailed description of the invention which is to be read in association with the accompanying drawings, wherein.

DESCRIPTION OF THE INVENTION

Figure 1:
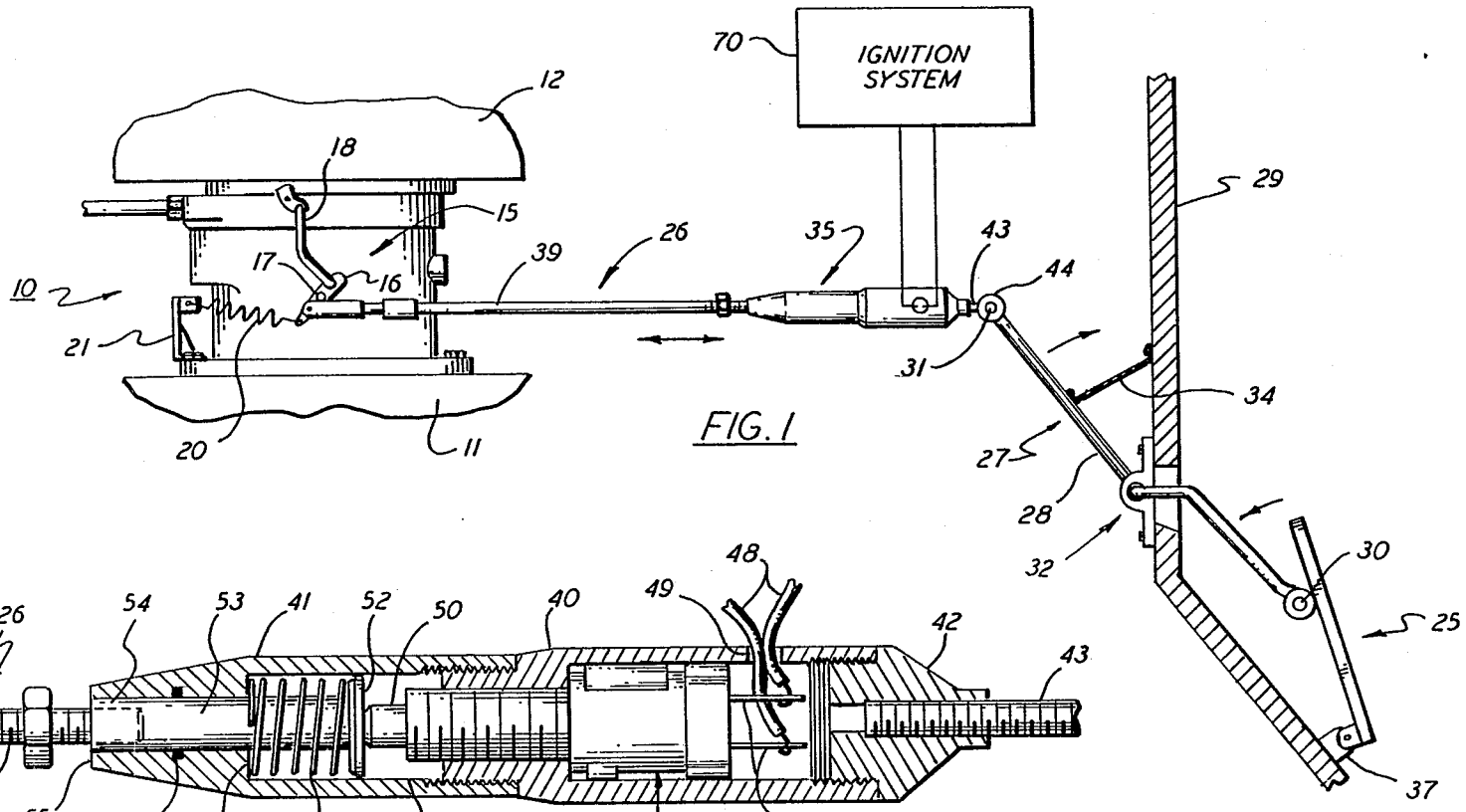
FIG. 1 is a diagrammatic view showing the present invention mounted in the accelerating system of a motor vehicle.

Referring initially to FIG. 1, there is illustrated a carburetor 10 mounted upon the manifold 11 of a motor vehicle engine. The carburetor is equipped with an air filter 12 and a conventional throttle linkage generally referenced 15. The linkage includes a lever 16 rotatably mounted upon the carburetor by means of a pivot pin 17. An arm 18 connects the top portion of the lever with a throttle plate 19 contained within the carburetor. A return spring 20 is anchored at one end in a bracket 21 and is attached to the bottom portion of the lever. The spring suctions to continually bias the lever in a clockwise direction as seen in FIG. 1 to pull the throttle plate into a closed or idle position. Turning the lever in a counterclockwise direction against the biasing force of the return spring causes the throttle plate to open thus delivering more fuel to the engine to increase the power output of the engine.

The throttle linkage 15 is operatively connected to an accelerator linkage 27 by means of a connecting linkage 26. The accelerator linkage includes a bent rocker arm 28 that passes through the firewall 29 of the driver's compartment. The rocker arm is rotatably mounted in a bearing assembly 32 with one end of the arm 31 being pivotably mounted in the connecting linkage 26 and the opposite end 30 being similarly mounted in a foot pedal assembly 25 mounted on the interior of the fire wall by a clevis and pin unit 37. Depressing the foot pedal causes the throttle lever 16 to rotate in a counter-clockwise direction as viewed in FIG. 1 against the biasing action of the return spring 20. This in turn, opens the throttle plate 19 producing an increase in engine speed. Releasing the foot pedal allows the extended return spring to pull the throttle arm back to an idle position. A flexible lanyard 34 is secured between the rocker arm and the firewall which restricts how far the rocker arm ca rotate in a counter-clockwise direction. This lanyard, as shown in FIG. 1, is fully extended when the engine is idling. At this time, the return spring, which is not permitted to fully unload, pulls against the lanyard and thus exerts a continuous pulling force against the connecting linkage 26. The importance of this action will be further explained below.

If the return spring fails for any reason when the throttle is in an open position, that is, a position other than idle, the driver ordinarily will not be able to reduce the engine speed and thus the speed of the vehicle. The same result ensues when any part of the throttle control mechanism becomes jammed or stuck when the throttle is opened. As noted above, safety devices have been devised which will automatically shut down the engine ignition system when the return spring breaks or becomes dislodged. Typically, a spring equipped cut-off switch is wired into the ignition system and the switch spring placed in opposition with the throttle return spring so that the cut-off switch remains closed so long as the throttle mechanism exerts a holding force against the switch spring. When the throttle mechanism is operating freely (unjammed) and the return spring breaks or becomes disconnected, the holding force of the switch spring is released, allowing the cut-off switch to open, thus shutting down the engine. However, if the throttle linkage becomes jammed or stuck with the throttle in an open position, the holding force on the switch spring will not be released and the engine will continue to run at the open throttle setting. The problem of a throttle jamming, as opposed to return spring failure, is encountered frequently in the sport of automobile racing. The problem generally occurs when the vehicle is moving at a high speed with the throttle in a wide open position. The driver is afforded little or no time to manually turn off the engine ignition at these speeds, and oftentimes loses control of the vehicle.

The present invention overcomes this type of problem by providing a spring-actuated, cut-off switch that will automatically shut down the engine of a motor vehicle in the event that the throttle return spring fails or any part of the throttle mechanism becomes jammed.

The connecting linkage 26 which couples the throttle linkage 15 to the accelerator linkage 27 includes an elongated rod 39 and a shut off switch housing 35.

Figure 2:
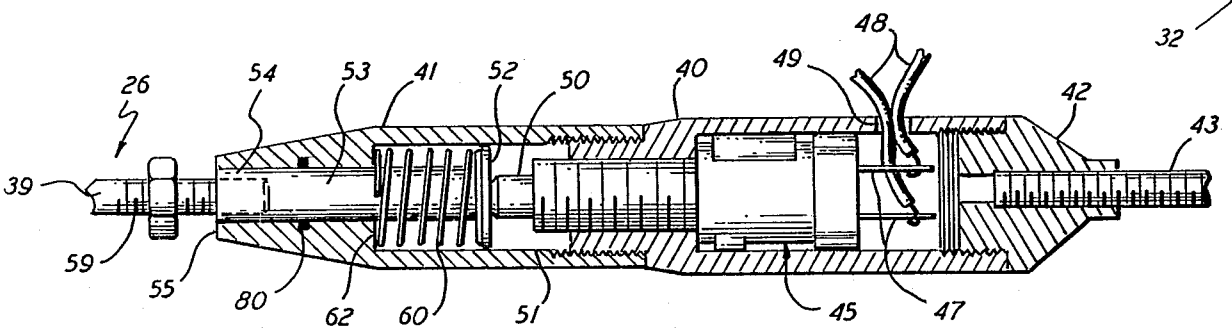
FIG. 2 is an enlarged partial view in section showing a housing that is part of the system of FIG. 1 which encloses a switch for shutting off the ignition of a motor vehicle.

The housing, as further illustrated in FIG. 2, has a body section 40, front end section 41, and a rear end section 42. The end sections are threaded onto the body section and serve to enclose the housing. An adjusting rod 43 is threaded into the rear end cap and terminates in a bearing cap 44 (FIG. 1) in which the rocker arm is journalled for rotation. A normally closed push button actuated cut-off switch 45 of any suitable and well known design is mounted within internal cavity 46 formed in the body section of the housing. A pair of electrical terminals 47 are disposed rearwardly from the switch and wire leads 48 are soldered to the terminals. The leads are brought out of the housing through hole 49 and are electrically connected into the engine ignition system 70 of the vehicle in a manner such that opening of the switch will immediately shut down the engine.

The normally closed cut-off switch 45 is cycled to an open condition by depressing the push button actuator 50 located at the front of the switch. The actuator extends into a bore 51 formed in the back of the front end section 41 and rests in contact against the head 52 of piston 53. The piston is slidably contained within a passageway 54 that passes axially into the bore through the front face 55 of the end section 41. The distal end of the connecting rod 39 includes a threaded shank 59 that is screwed into the front of the piston 53. The piston is thus normally pulled away from the push button actuator by the action of the return spring regardless of the throttle position.

A cut-off spring 60 is wound about the back part 61 of the piston 53. The spring is contained within bore 51 and is arranged to act between the end wall 62 of the bore and the head 52 of the piston. The strength of the cut-off spring is less than that of the return spring. Under normal conditions the piston is pulled away from the cutoff switch actuator by the return spring and the cut-off spring is compressed into a loaded condition. The return spring force on the piston is continuous throughout the full range of the accelerator. When the accelerator is placed in an idle position, lanyard 34 is taut or fully extended so that it, rather than the foot pedal, resists the return spring. When the accelerator is depressed, however, the connecting linkage is pulled back by the accelerator linkage against the biasing action of the return spring whereby the piston continues to be pulled away from the cut-off switch actuator button. As can be seen, the piston will remain in the normal position as the accelerator moves back and forth through its full range of settings or positions.

However, in the event that the throttle fails for any reason while in an open position, the cut-off spring will be immediately released and allowed to drive the piston against the cut-off switch actuator button thus cycling the cut-off switch and shutting down the engine. It should be noted that because the cut-off switch acts between the housing and the piston, the cutoff switch can be cycled by the cut-off spring forcing the piston back in the event that the throttle linkage becomes jammed or that the return spring breaks or becomes disconnected.

Although the connecting member is shown in FIG. 1 as being an elongated linear rod, it can also be formed of a flexible cable having sufficient strength to pull against the force of the return spring without breaking. It should also be noted that a stop nut is threaded upon the threaded shank 59 of the connecting member which can be used to limit the linear travel of the piston 53 and thus prevent the switch from being damaged at the time of shut down. The threaded adjusting rod 43 permits the overall length of the connecting linkage to be rapidly and efficiently adjusted so that the shut-off device of the present invention can be adapted for use in association with almost any existing throttle mechanism.

In practice, the interior of the housing can be filled with a lubricant to both protect and lubricate the witch components. An O-ring seal 80 is placed about the piston to prevent the lubricant from leaking past the piston and the threaded connections of the housing are treated with an epoxy resin thereby rendering the interior of the housing fluid tight. The cut-off switch is not only completely protected within the housing but the moving switch parts are prevented from binding to provide a device that will function under the most hostile conditions.

While this invention has been explained with reference to the structure disclosed herein, it is not confined to the details set forth and this application is intended to cover any modifications and changes as may come within the scope of the following claims.

What is claimed is:

1. Apparatus for connecting the return spring of a throttle linkage to a movable accelerator for immediately shutting down the engine of a motor vehicle when the throttle fails in an open position that includes:

a switch housing attached to an accelerator means such that said switch housing will move with the accelerator means through a range of accelerator positions, a normally closed switch for shutting down the engine, said switch being mounted in said housing, a piston slidably mounted within the housing for cycling said switch, said piston being movable between a first normal position and a second switch opening position wherein the engine is shut down, a member connecting the piston to the return spring in the throttle linkage whereby the return spring holds the piston in the first normal position as the accelerator is moved through its range of positions, and a cut-off spring acting between the housing and the piston, said cut-off spring having less spring strength than the return spring so that the cut-off spring will move the piston into the second switch opening position when the return spring force is removed from the piston.

2. The apparatus of claim 1 wherein said member is a metal rod.

3. The apparatus of claim 1 wherein said member is a flexible cable.

4. The apparatus of claim 1 wherein said accelerator includes a manually operated foot pedal and a rocker arm for attaching the housing to the foot pedal.

5. The apparatus of claim 1 wherein said member has an adjusting means for positioning the member between the piston and the throttle linkage.

6. The apparatus of claim 1 that further includes a stop means for preventing travel of the housing in one direction beyond the idle position.

7. Apparatus for immediately shutting down the engine ignition system of a motor vehicle in the event the throttle fails in an open position, that includes a carburetor having a throttle linkage connected to a throttle plate and a return spring acting on the linkage to urge the plate into a closed position, a connecting member attached at one end to the throttle linkage whereby pulling the member against the biasing action of the return spring causes the linkage to move the throttle plate to an open position and releasing the member permits the return spring to pull the linkage back thereby closing the throttle plate.

a housing connected to a manually operated accelerator such that said housing moves with said accelerator means a shut-off switch mounted in the housing that is wired into the engine ignition system, said shut-off switch having a push button actuator for cycling the shut-off switch from a normally closed position to an open position when said push button actuator is depressed, a piston slidably mounted in said housing that is arranged to move between a first retracted position and a second extended position wherein said piston depresses push button said actuator, said piston being secured to the other end of the connecting member for movement therewith, a cut-off spring acting between the housing and the piston for moving the piston into the second extended position to cycle said switch when either the return spring fails or the throttle linkage becomes jammed.

8. The apparatus of claim 7 wherein said connecting member is an elongated rod that is threaded into the piston.

9. The apparatus of claim 7 wherein said connecting member is a flexible member that is normally held taut between the throttle linkage and the piston.

10. The apparatus of claim 7 that further includes adjusting means for positioning the housing between the accelerator and the connecting member.

11. The apparatus of claim 7 wherein said accelerator means includes is a foot pedal that is attached to the housing by a lever arm.

12. The apparatus of claim 7 wherein the housing further includes seal means for containing a lubricant within said housing.

13. The apparatus of claim 7 wherein said connecting member further includes a stop means for limiting the movement of said piston within said housing.

14. The apparatus of claim 7 that further includes a stop means that limits the range of the accelerator means.

* * * * *